US009308142B2

(12) United States Patent
Harding

(10) Patent No.: US 9,308,142 B2
(45) Date of Patent: Apr. 12, 2016

(54) SPORTS WHEELCHAIR

(71) Applicant: VRD Products, Inc., Arlington, TX (US)

(72) Inventor: William V Harding, Arlington, TX (US)

(73) Assignee: VRD Products, Inc., Arlington, TX (US)

( * ) Notice: Subject to any disclaimer, the term of this patent is extended or adjusted under 35 U.S.C. 154(b) by 0 days.

(21) Appl. No.: 14/246,120

(22) Filed: Apr. 6, 2014

(65) Prior Publication Data

US 2015/0157516 A1 Jun. 11, 2015

Related U.S. Application Data

(60) Provisional application No. 61/914,356, filed on Dec. 10, 2013.

(51) Int. Cl.

| | |
|---|---|
| ***A61G 5/02*** | (2006.01) |
| *A61G 5/10* | (2006.01) |
| *A61G 5/12* | (2006.01) |

(52) U.S. Cl.

CPC ..... *A61G 5/02* (2013.01); *A61G 2005/1054* (2013.01); *A61G 2005/1083* (2013.01); *A61G 2005/1089* (2013.01); *A61G 2005/122* (2013.01); *A61G 2005/128* (2013.01); *Y10T 29/49826* (2015.01)

(58) Field of Classification Search

CPC ..... A61G 5/02; A61G 5/04
USPC ..... 280/250.1
See application file for complete search history.

(56) References Cited

U.S. PATENT DOCUMENTS

| | | | | |
|---|---|---|---|---|
| 2,746,523 | A * | 5/1956 | De La Cuesta | 297/322 |
| 4,483,653 | A | 11/1984 | Waite | |
| 4,542,917 | A | 9/1985 | Waite | |
| 4,693,490 | A * | 9/1987 | Loodberg et al. | 280/650 |
| 4,930,842 | A * | 6/1990 | Wilkinson et al. | 297/466 |
| 5,028,065 | A | 7/1991 | Danecker | |
| 5,116,067 | A | 5/1992 | Johnson | |
| 5,480,179 | A | 1/1996 | Peacock | |
| 5,639,105 | A * | 6/1997 | Summo | 280/250.1 |
| 5,758,926 | A | 6/1998 | Wilkie | |
| 6,786,496 | B2 | 9/2004 | Ward | |
| 6,886,843 | B1 * | 5/2005 | Papac | 280/250.1 |
| 7,090,240 | B2 * | 8/2006 | Papac | 280/647 |
| 2006/0097562 | A1 | 5/2006 | Hiruta | |
| 2012/0326473 | A1 * | 12/2012 | Salvan | 297/180.1 |
| 2013/0277940 | A1 | 10/2013 | Nasser | |

* cited by examiner

*Primary Examiner* — Kevin Hurley
*Assistant Examiner* — Felicia L Brittman

(57) ABSTRACT

A wheelchair includes a chassis; first and second wheels coupled to the opposites sides of the chassis; a front caster; and a rear caster. The chassis includes a base plate; a back plate; first and second side plates; a rear plate; and a seat coupled to the back plate and the first and second side plates opposite the base plate.

20 Claims, 7 Drawing Sheets

SPORTS WHEELCHAIR

CROSS-REFERENCE TO RELATED APPLICATION(S)

This application claims benefit of U.S. Provisional Application No. 61/914,356, filed 10 Dec. 2013, entitled "SPORTS WHEELCHAIR," which is incorporated herein by reference in its entirety.

FIELD OF THE DISCLOSURE

This disclosure, in general, relates to wheelchairs, such as wheelchairs for use in adapted sports related activities.

BACKGROUND

Wheelchair-based sports are becoming increasingly popular. With the increased popularity, demand for maneuverable and durable wheelchairs has increased. In particular, the many sports of Paralympics have received increased interest. In addition, national leagues sports, such as wheelchair basketball, have emerged and become popular. Moreover, more cities are offering venues for wheelchair-based sports.

One of the drivers of increased interest is GAO-10-519 which published in June 2010 and which indicated that more should to be done to meet the regulations defined in the Rehab Act of 1973, the Americans with Disabilities Act (ADA), and the Individuals with Disabilities Education Act (IDEA). The study indicated that, while there had been some progress, there is still much that should be done.

Sports wheelchairs are usually custom fitted to the user, but to meet various government regulations, an institutional-type sports wheelchair would be desirable. Another approach that has led to higher participation is the practice of filling out teams with able-bodied players. Many times a school does not have enough disabled students for disabled-only teams. In the past, students have been excluded because there were not enough players. Work by the American Association for Adapted Sports Programs has shown that the teams can be filled out by using able-bodied students, in wheelchairs, to have enough players to play a game.

Conventional everyday wheelchairs are hard to maneuver and lack durability. Everyday chairs are dangerous if used in a sports environment because they lack stability during high energy maneuvering and play. Suppliers have adapted conventional tubular construction and spoke wheels to provide increased maneuverability. However, such designs tend to be expensive, difficult to repair, and difficult to maintain.

In particular, the increasing skill level of players and the rigors of aggressive play place greater stress on components of the wheelchair, increasing wear and tear on wheelchair components. When adapting conventional wheelchair construction, manufacturers sought to strengthen weak points in conventional designs to increase durability. However, such adaptations have proven expensive to manufacture. Moreover, damage is difficult to repair, often requiring an expert technician and great expense.

As such, an improved wheelchair for athletes would be desirable.

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In an exemplary embodiment, a wheelchair chassis is formed using plate-based construction, providing a monocoque structure. In a particular example, side plates, a back plate, or a rear plate extend from a base plate to support a seat. Wheels can be attached to axles extending from an axle support, such as an axle tube, connected to one of the side plates, back plate, or rear plate. The wheels can be cambered. In addition, one or more front or rear casters can be connected to the base plate. In an example, an axle block fits in an axle tube. The camber can be implemented by an angled axle hole that is drilled in the axle block.

Figure 1:
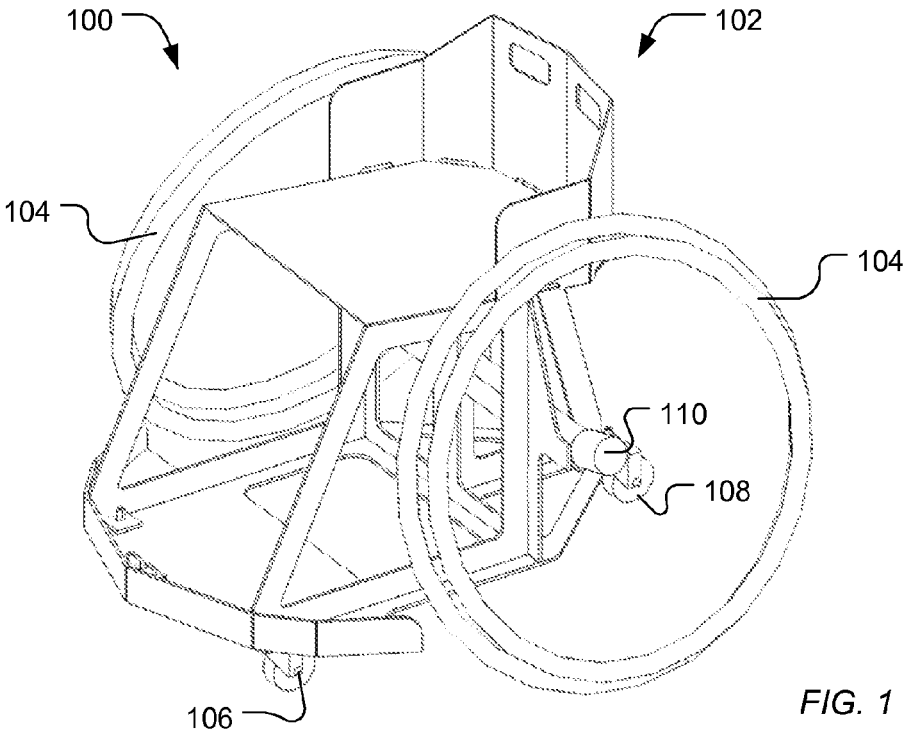
FIG. 1 includes an orthographic illustration of an exemplary wheelchair.

In an example, a wheelchair 100 illustrated in FIG. 1 includes a chassis 102. Wheels 104 are connected to the chassis 102 with an axel extending through a hub 110. The axle passes through the hub and into the axle block. In particular, the hub 110 is connected to the axle. A quick-release axle that has a pushbutton that causes a small ball bearing to retract into the axle shaft can be used. The wheels 104 can rotate around the axle to which the hub 110 is connected. In an example, the wheels 104 are cast wheels. Alternatively, the wheels can be spoke wheels. Tires of the wheels can be pneumatic or, alternatively can be non-pneumatic.

Figure 2:
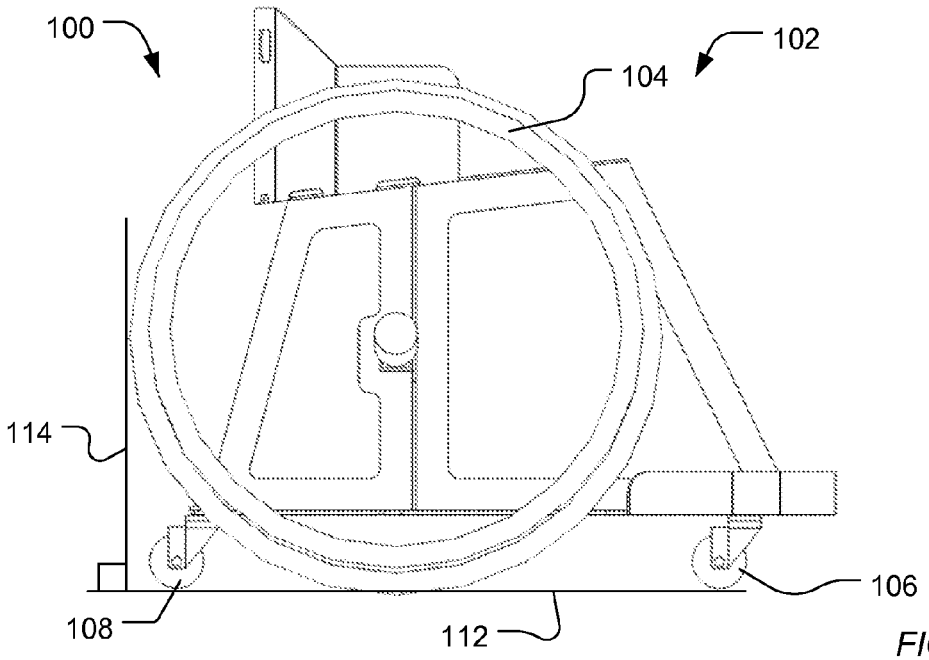
FIG. 2 includes a side view illustration of an exemplary wheelchair.

One or more casters can be pivotably connected to the chassis. For example one or more front casters 106 can be pivotably connected to the chassis 102, and one or more rear casters 108 can be pivotably connected to the chassis 102. From a side view illustrated in FIG. 2, the lowest point of the wheels 104 and the front casters 106 are to contact the ground and define a ground plane 112. Generally, the rear caster 108 can also contact the ground plane. Alternatively, the rear caster 108 can rest above the ground plane. As further illustrated in FIG. 2, a rear plane 114 is perpendicular to the ground plane 112 and extends vertically and tangentially along and between the rearmost points of the wheels 104.

In an example, the rearmost point of the rear caster 108 can contact the vertical plane 114. In another example, the vertical plane 114 can cross through the rear caster 108. In a further example, the rear caster 108 can reside entirely to the rearward side of the vertical plane 114.

Figure 3:
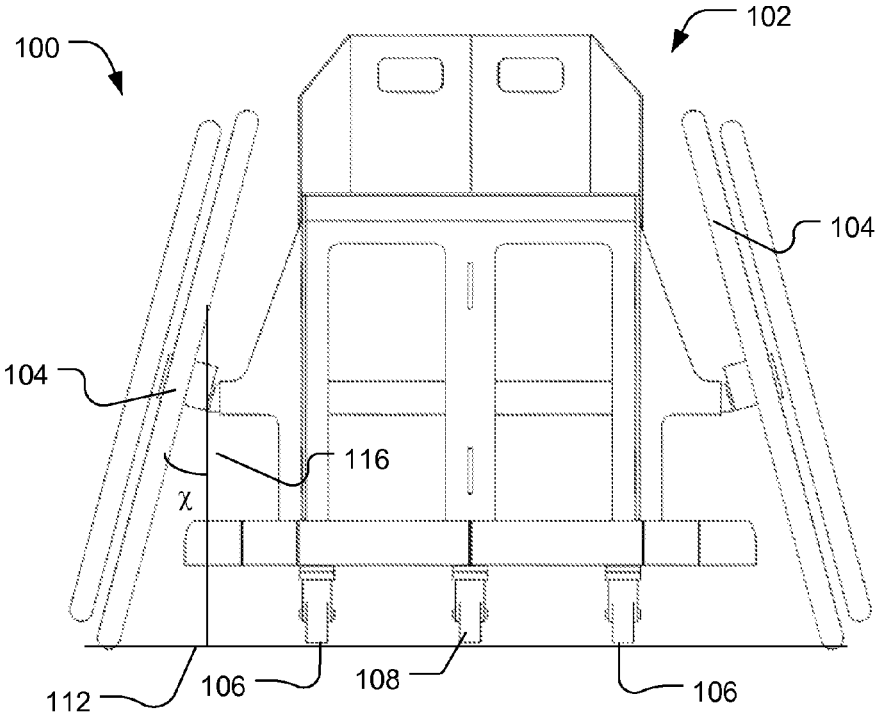
FIG. 3 includes a front view illustration of an exemplary wheelchair.
Figure 4:
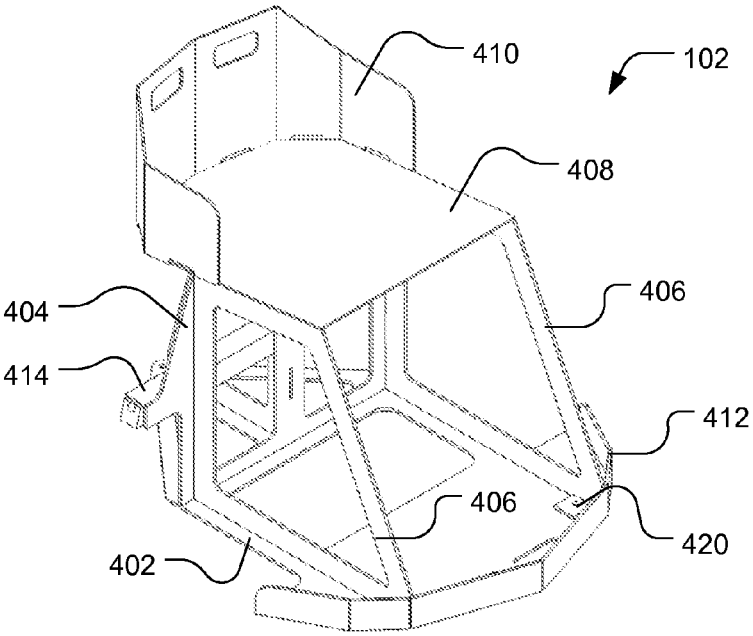
FIG. 4 and FIG. 5 include orthographic views of an exemplary chassis.
Figure 5:
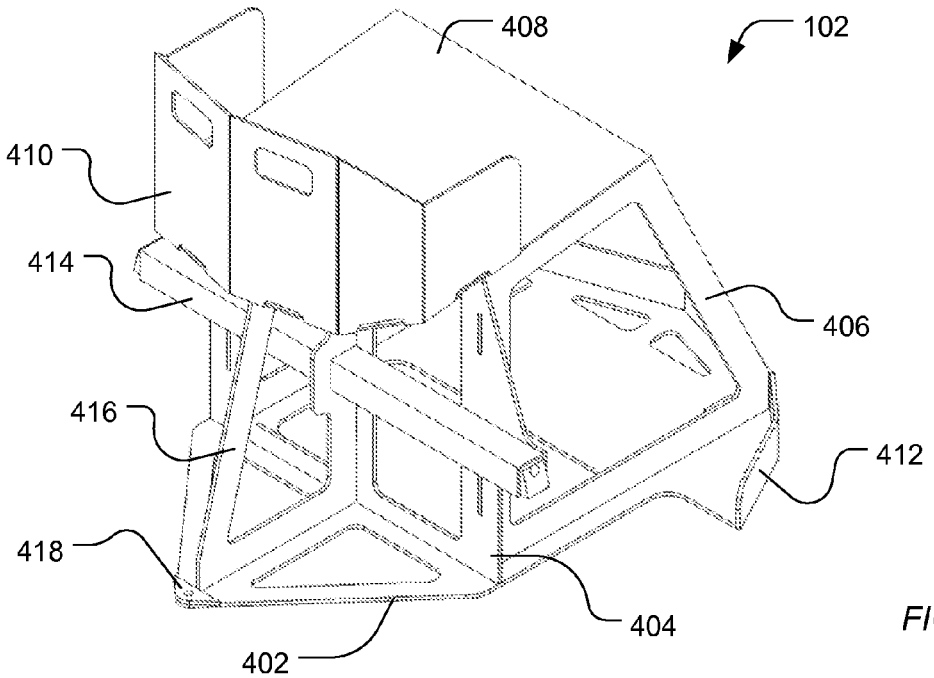

Further, the wheels 104 can be cambered relative to a vector 116 normal to the ground plane 112. As illustrated in FIG. 3, the wheels 104 can be cambered at an angle $\chi$ in a range of 5° to 35°, such as a range of 5° to 25°, a range of 10° to 20°, or even a range of 13° to 17°. For example, the wheels 104 can be cambered at an angle $\chi$ of approximately 15°.

An exemplary chassis 102 is illustrated in FIG. 4, FIG. 5, FIG. 6, FIG. 7, FIG. 8, FIG. 9, and FIG. 10. The chassis 102 includes a base plate 402. In an example, the base plate 402 is parallel to the ground plane. Alternatively, the base plate 402 can be askew from the ground plane. A back plate 404 and side plates 406 extend up from the base plate 402 and away from the ground plane. Optionally, a rear plate 416 extends up from the base plate 402 and away from the ground plane. A seat 408 is secured to the back plate 404 and the side plates 406 and is positioned opposite the base plate 402 and away from the ground plane. A back support 410 can be secured to the seat 408.

An axle support, such as axle tube 414, can be secured along the back plate 404 and optionally the rear plate 416. As illustrated, the axle tube 414 is disposed rearward of the back plate 404. Alternatively, the axle tube 414 can be disposed on the front side of the back plate 404 and can further contact the side plates 406.

The chassis 102 can further include a bumper 412 secured to the front of the base plate 402. The chassis 102 can be configured to receive front casters through the base plate 402 and optional caster plates 420. Similarly, a rear caster can be secured to the chassis 102 through the base plate 402 and optionally a rear caster plate 418. In particular, the caster plates 420 and 418 provide additional support material around pivot bolts of the casters. Alternatively, the rear caster plate 418 can be secured to the base plate 402 and extend rearward from the base plate 402. A rear caster can be secured to the rear caster plate 418 at a position further rearward than the base plate 402.

The base plate 402 can be formed of a sheet material, such as a metal sheet. In particular, the base plate 402 can be formed of aluminum, titanium, steel, other structural metal, alloys thereof, or a combination thereof. In another example, the sheet material can be a polymeric or a composite material, such as carbon fiber plate. The base plate 402 can further include cutouts providing specific aesthetic design or reducing weight. In a particular example, the sheet material of the base plate 402 has a thickness in a range of 0.1 to 1.0 inches, such as a range of 0.15 to 0.35 inches. In an example, the configuration of the base plate 402 can be formed by stamping the sheet material to leave the desired patterns of cutouts, tabs, slots, or features. In another example, the base plate 402 can be patterned using a computer controlled rectilinear motion laser table or water jet.

Figure 6:
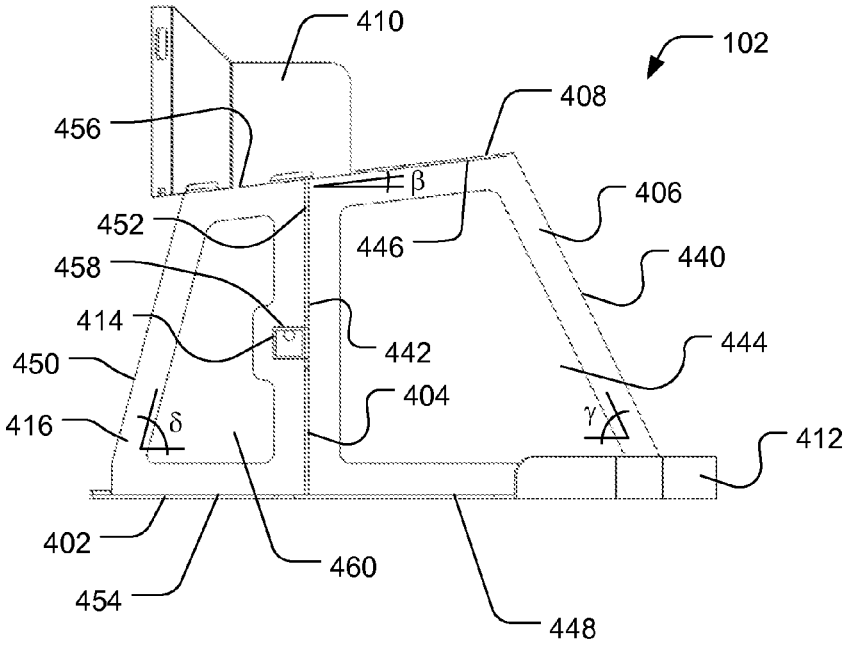
FIG. 6 includes a side view illustration of an exemplary chassis.
Figure 7:
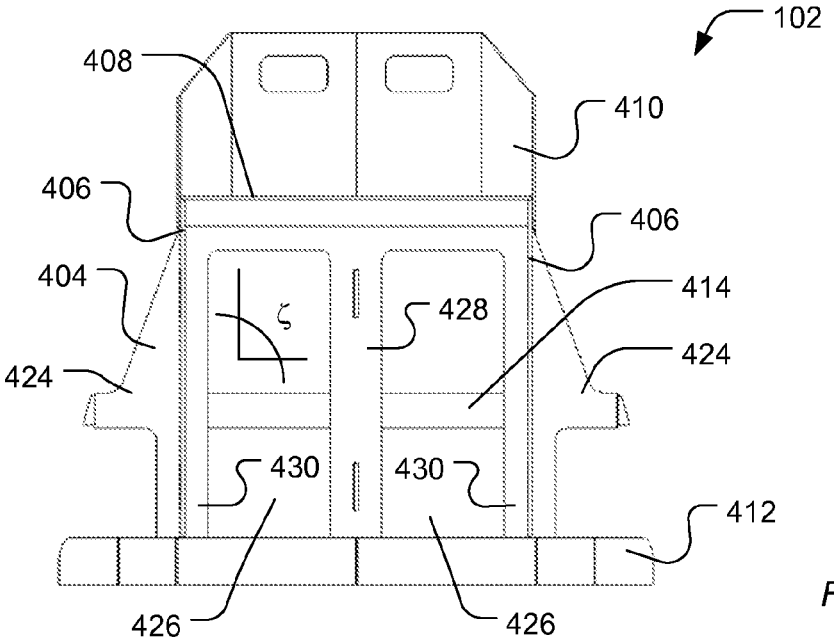
FIG. 7 includes a front view illustration of an exemplary chassis.
Figure 8:
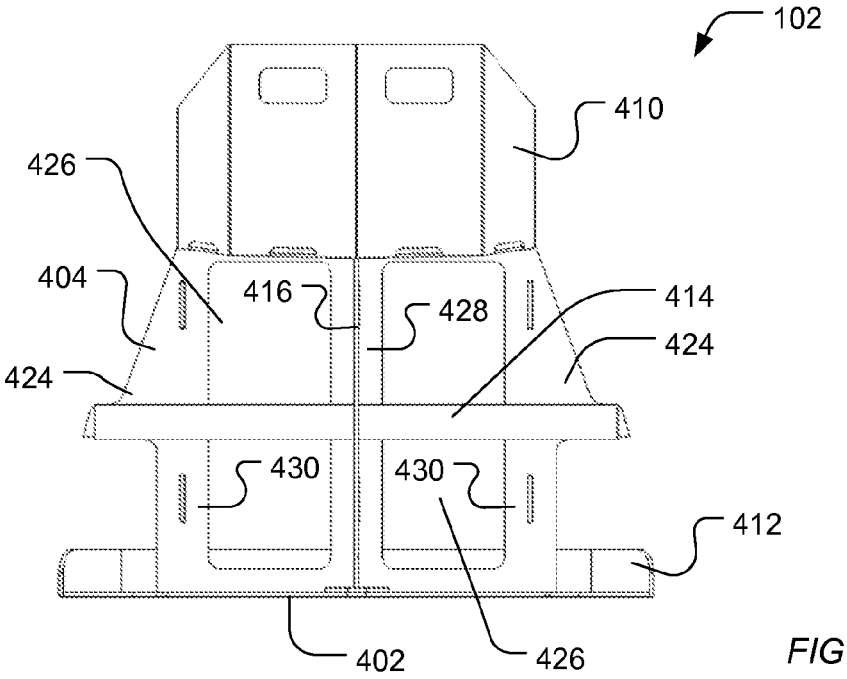
FIG. 8 includes a rear view illustration of an exemplary chassis.

When viewed from the front as illustrated in FIG. 7 or when viewed from the back as illustrated in FIG. 8, the back plate 404 extends upward from the base plate 402 away from a ground plane and toward the top of the chassis 102. The seat 408 can be secured to the back plate 404 opposite the base plate 402. When viewed from the side, as illustrated in FIG. 6, the back plate 404 extends vertically from the base plate 402 and perpendicular to the ground plane. Alternatively, the back plate 404 can extend upward at an angle skew from a normal to the ground plane or relative to the base plate 402.

The back plate 404 can further include wings 424 extending to the sides of the chassis 102. Such wings 424 can provide additional support to the axle tube 414. Optionally, the back plate 404 can include one or more cutouts 426. In particular, the cutouts 426 are configured to leave at least a central extension 428 to which, for example, the rear plate 416 can be attached. Alternatively, the back plate 404 can include more than one central extension when the chassis includes more than one rear plate. Further, the back plate 404 includes extensions 430, to which, for example, the side plates 406 can be attached.

The back plate 404 can be formed of a sheet material, such as a metal sheet material. In particular, the back plate 404 can be formed of a metal sheet including steel, aluminum, titanium, other structural metals, alloys thereof, or a combination thereof. In another example, the sheet material can be a polymeric or a composite material, such as a carbon fiber plate. In a particular example, the sheet material of the back plate 404 has a thickness in a range of 0.1 to 1.0 inches, such as a range of 0.15 to 0.35 inches. In an example, the configuration of the back plate 404 can be formed by stamping the sheet material to leave the desired patterns of wings 424, cutouts 426, extensions 428 and 430 or other tabs, slots, or features. In another example, the back plate 404 can be patterned using a computer controlled rectilinear motion laser table or water jet.

When viewed from the side as illustrated in FIG. 6, a side plate 406 extends from the base plate 402 upward and away from the ground plane and extends from a front side of the back plate 404 toward the front of the chassis 102. A lower edge 448 of the side plate 406 can be in contact with the base plate 402 and a back edge 442 of the side plate 406 can be in contact with the back plate 404. A leading edge 440 of the side plate 406 extends up from the base plate 402 and forms a front edge of the chassis 102. The leading edge 440 can be vertical and perpendicular to the ground plane. Alternatively, within the plane of the side plate 406, the leading edge 440 can extend along an angle $\gamma$ of at least 35° defined relative to the ground plane. For example, the angle $\gamma$ can be in a range of 45° to 135°, such as a range of 45° to 105°, a range of 45° to 90°, or a range of 50° to 85°.

A top edge 446 of the side plate 406 can be parallel to the ground plane. Alternatively, the top edge 446 of the side plate 406 can be disposed at an angle $\beta$ relative to the ground plane. When the seat 408 is secured to the top edge 446 of the side plate 406, the seat 408 can have the angle of the top edge 446. In particular, the angle $\beta$ can be in a range of 5° to 25°, such as in a range of 5° to 20°, in a range of 5° to 15°, a range of 5° to 12°, or even in a range of 7° to 12°. In particular, the seat 408 can have a dump, defined as the change in height from the front edge of the seat to the back edge of the seat 408, in a range of 1.5 inches to 2.5 inches, such as 1.8 inches to 2.2 inches. Further, the side plate 406 can include a cutout 444 to provide desirable aesthetics and reduce weight.

Figure 9:
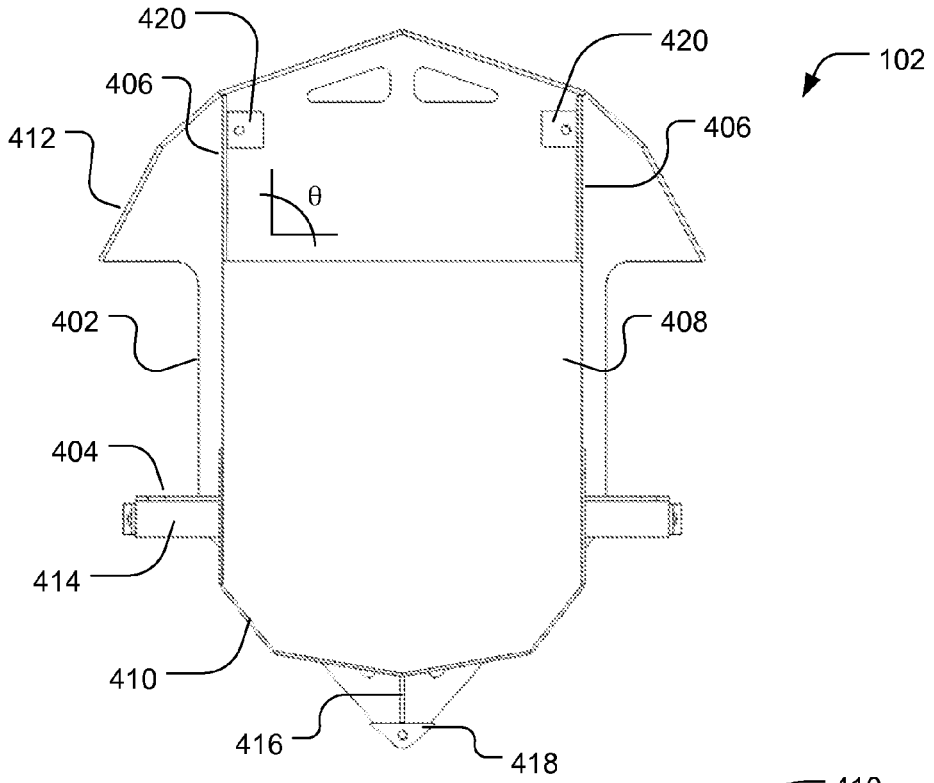
FIG. 9 includes a top view illustration of an exemplary chassis.

When viewed from the top as illustrated in FIG. 9, the side plates 406 extend from the back plate 404 towards the front of the chassis 102 in a parallel direction, for example, perpendicular to the back plate 404. Alternatively, the side plates 406 can be angled inwardly in which the side plates 406 become closer together as they extend away from the back plate 404. In another example, the side plates 406 can be angled outwardly to become further apart as they extend from the back plate 404. In particular, the side plates 406 can extend along an angle $\theta$ relative to the back plate 406, where angles less than 90° represent the side plates 406 extending inward and angles greater than 90° represent the side plates 406 extending outward relative to the plane of the back plate 404. For example, the angle $\theta$ can be in a range of 75° to 135°, such as a range of 75° to 120°, a range of 75° to 105°, or even a range of 85° to 100°.

When viewed from the front, as illustrated in FIG. 7, the side plates 406 can extend from the base plate 402 in a vertical direction perpendicular to the ground plane. Alternatively, the side plates can be angled relative to the plane extending perpendicular from the back plate 404. In particular, the side plates 406 can be angled to approach each other or be closer together, away from the base plate 402 or alternatively, can be angled to be further away from each other away from the base plate 402. In particular, a side plate 406 has an angle ζ in a range of 45° to 135°, such as a range of 60° to 120°, a range of 75° to 105° or even a range of 85° to 95° defined relative to the ground plane.

In a particular example, the seat 408 is located so that the center of gravity is slightly forward of the axle centerline. The side plate angle γ can be selected so that the leading edge 440 of the side plate 406 connects the leading edge of the seat 408 with the top of the bumper 412.

The side plates 406 can be formed of a sheet material, such as a metal sheet material. In particular, the side plates 406 can be formed of a metal sheet including steel, aluminum, titanium, other structural metals, alloys thereof, or a combination thereof. In another example, the sheet material can be a polymeric or a composite material, such as a carbon fiber plate. In a particular example, the sheet material of the side plate 406 has a thickness in a range of 0.1 to 1.0 inches, such as a range of 0.15 to 0.35 inches. In an example, the configuration of the side plate 406 can be formed by stamping the sheet material to leave the desired patterns of cutouts, extensions, tabs, slots, or features. In another example, the side plates 406 can be patterned using a computer controlled rectilinear motion laser table or water jet.

When viewed from a side view, as illustrated in FIG. 6, a rear plate 416 can have a lower edge 454 in contact with the base plate 402 and a front edge 452 in contact with a back surface of the back plate 404. In particular, the rear plate 416 extends upward from the base plate 402 and rearward from the back plate 404. In addition, the rear plate 416 can have an upper edge 456. The upper edge 456 can be parallel to a ground plane. Alternatively, the upper edge 456 can have an angle β relative to the ground plane similar to that of the side plates 406.

As illustrated, the seat 408 can be in contact with the upper edge 456 of the rear plate 416. The rear plate 416 can also include a back edge 450 defining a rear of the chassis 102. The back edge 450 can extend along an angle δ relative to the ground plane. In particular, the angle δ can be in a range of 45° to 135° in which angles less than 90° indicate that the top edge 456 of the rear plate 416 is shorter than the bottom edge 454. For example, the angle δ can be in a range of 70° to 110°, such as in a range of 75° to 105°. Further, the leading edge 452 can be shaped to accommodate the axle tube 414, for example, at 458. Alternatively, when the axle tube 414 extends from a front side of the back plate 404, the side plates 406 can be shaped to receive the axle tube 414. The rear plate 416 can also include cutouts 460 to improve aesthetics and reduce weight.

In a particular example, the seat 408 is located so that the center of gravity is slightly forward of the axle centerline. The side plate angle γ can be selected so that the leading edge 440 of the side plate 406 connects the leading edge of the seat 408 with the top of the bumper 412. Likewise, the rear plate angle δ can be selected so that the back edge 450 of the rear plate 416 connects the rear of the seat 408 with a point just forward of the rear caster.

The rear plate 416 can be formed of a sheet material, such as a metal sheet material. In particular, the rear plate 416 can be formed of a metal sheet including steel, aluminum, titanium, other structural metals, alloys thereof, or a combination thereof. In another example, the sheet material can be a polymeric or a composite material. In a particular example, the sheet material of the rear plate 416 has a thickness in a range of 0.1 to 1.0 inches, such as a range of 0.15 to 0.35 inches. In an example, the configuration of the rear plate 416 can be formed by stamping the sheet material to leave the desired patterns of cutouts, extensions, tabs, slots, or features. In another example, the rear plate 416 can be patterned using a computer controlled rectilinear motion laser table or water jet.

When viewed from a back view as illustrated in FIG. 8, the rear plate 416 extends vertically, perpendicular to the base plate 402. Alternatively, the system can include more than one rear plate 416. Such rear plates 416 can extend vertically perpendicular to the ground plane or the base plate 402. Alternatively, multiple rear plates can extend inwardly to be closer together at the seat 408 than at the base plate 402 or can extend outwardly to be further apart approaching the seat 408 than when close to the base plate 402.

Figure 13:
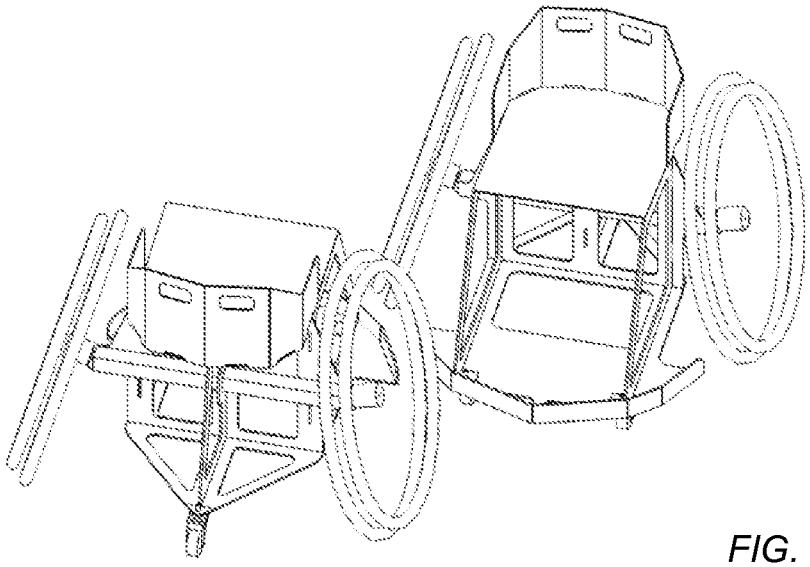
FIG. 13 includes an illustration of exemplary wheelchairs in contact.

The bumper 412 extends along a front edge of the base plate 402, illustrated, for example, in a top view illustrated in FIG. 9. The bumper 412 can be curved or alternatively, can have a partial polygonal shape to match a front edge of the base plate 402. The shape of the bumper 412 can prevent two chairs from approaching straight on at each other from being able to stick a wheel inboard of a main wheel and in between the main wheel and the chassis. FIG. 13 includes an illustration of two chairs in contact. The shape of the bumper 412 can be selected to cause one chair to deflect or slide past in contrast to a head on collision. In particular, the bumper 412 can be formed of the sheet material, such as a metal sheet material. For example, the bumper 412 can be formed of a metal sheet including steel, aluminum, titanium, other structural metals, alloys thereof, or a combination thereof. In another example, the sheet material can be a polymeric or a composite material, such as a carbon fiber plate. In a particular example, the sheet material of the bumper 412 has a thickness in a range of 0.1 to 1.0 inches, such as a range of 0.15 to 0.35 inches.

The seat 408 can be formed of a sheet material, such as a metal sheet material. In particular, the seat 408 can be formed of a metal sheet including steel, aluminum, titanium, other structural metals, alloys thereof, or a combination thereof. In another example, the sheet material can be a polymeric or a composite material, such as a carbon fiber sheet. In a particular example, the sheet material of the seat 408 has a thickness in a range of 0.1 to 1.0 inches, such as a range of 0.1 to 0.25 inches. In an example, the configuration of the seat 408 can be formed by stamping the sheet material to leave the desired patterns of cutouts, extensions, tabs, slots, or features. In another example, the seat 408 can be patterned using a computer controlled rectilinear motion laser table or water jet. The seat 408 can be a flat sheet or can be shaped to accommodate the form of the backside or legs of a user.

The back support 410 can be formed of a sheet material, such as a metal sheet material. In particular, the back support 410 can be formed of a metal sheet including steel, aluminum, titanium, other structural metals, alloys thereof, or a combination thereof. In another example, the sheet material can be a polymeric or a composite material, such as a carbon fiber sheet. Alternatively, the back support 410 can be formed of a molded plastic. In particular, when the seat 408 and a top edge of the side plates 406 have an angle β, the back support 410 can be secured along the seat 408 and attached to the side plates 406. The back support 410 and optionally the seat 408 can include cutouts or ridges to assist with attaching straps to secure a user into the seat.

The chassis 102 can further include connections for straps. An exemplary strap configuration can be thigh straps, waist straps, and chest straps and can be used in various combinations. The strap configuration used can depend on the level of the spinal cord injury, if one exists. The higher the spinal cord injury the more support utilized. Foot straps can also be used to keep the occupants legs within the footrest area of the chair and to prevent the user from using their foot as a brake.

The axle tube 414 is illustrated as a tube having a square cross-section. Alternatively, the axle tube 414 can have a circular cross-section or a polygonal cross-section. Axles can be secured to axel blocks within the axle tube 414. In particular, the axles can be quick release axles.

Figure 10:
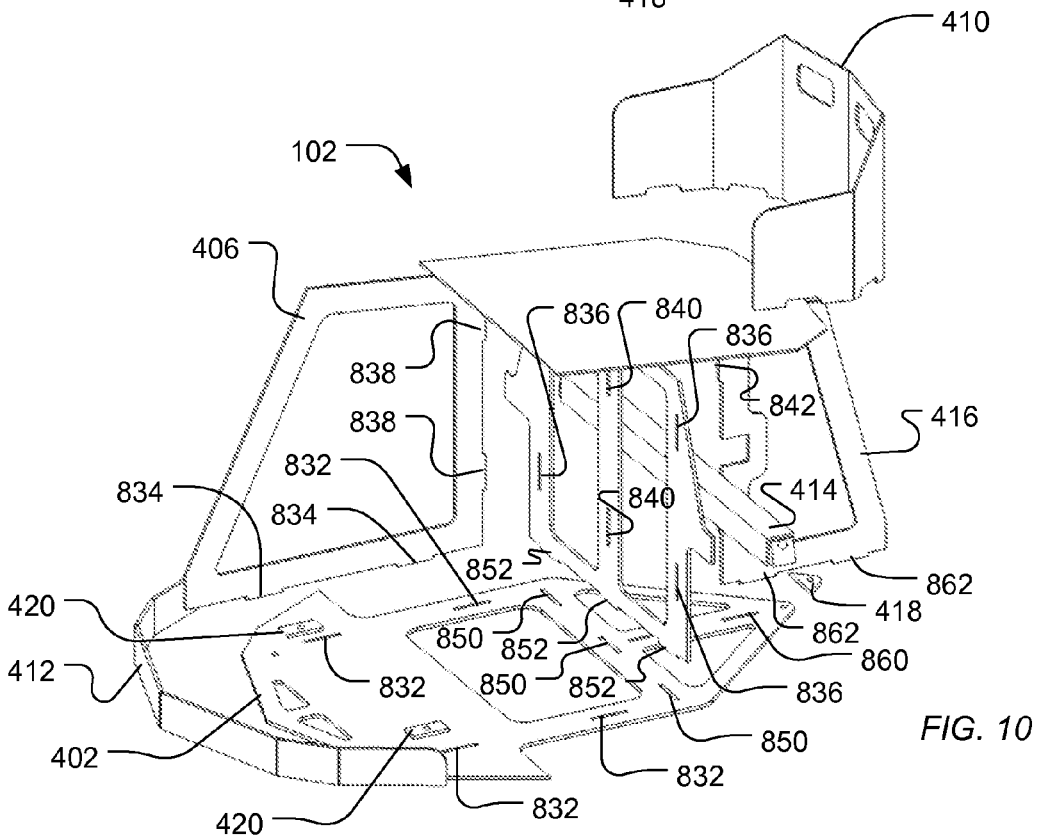
FIG. 10 includes an expanded view illustration of components of an exemplary chassis.

In a particular example illustrated in FIG. 10, the chassis 102 can be assembled based on a set of slots and tabs on respective parts. For example, the base 402 can include one or more side slots 832 to receive tabs 834 of the side plates 406. The base 402 can further include one or more back slots 850 to receive tabs 852 of the back plate 404. In addition, the base plate 402 can include one or more rear slots 860 to receive tabs 862 of the rear plate 416.

In addition, the back plate 404 can include side slots 836 to receive tabs 838 of the side plates 406. The back plate 404 can also include rear slots 840 to receive tabs 842 of the rear plate 416. The caster plates 420 or 418 can be moved into place over the base plate 402 following assembly of the side plates 406, back plate 404, or rear plate 416. In addition, the bumper 412 can be secured to the leading edge of the base plate 402. Once assembled, the seat 408 can be secured to the side plates 406, back plate 404, or the rear plate 416.

In an example, the seat 408 can be welded to one or more of the side plates 406, the back plate 404, or the rear plate 416. In addition, along edges near tabs, the side plates 406 can be welded to the base plate 402 or the back plate 404, and the rear plate 416 can be welded to the base plate 402 or back plate 404. The bumper 412 can be welded to the base plate 402 or can be secured using screws or bolts. The back support 410 can be welded to the seat 408. Alternatively, the back support 410 can be secured using bolts or other fasteners to secure the back support 410 to the seat 408 or the side plates 406. Alternatively or in addition, the components can be secured using mortise and tenon construction. Tabs can include openings for pins or wedges. The plates can be secured by applying tabs through slots and securing the pins or wedges to the portions of the tabs extending through the slots.

The axle tube 414 is secured to the back plate 404. As illustrated, the axle tube 414 is secured at the rear of the back plate 404. Alternatively, the axle tube 414 can be secured to the front side of the back plate 404. In an example, the axle tube 414 is secured using bolts, screws, or other fasteners. Alternatively, the axle tube 414 can be welded along the back plate 404. Optionally, the axle tube 414 can be applied to the back plate 404 prior to securing the rear plate 416 to the back plate 404 or the base 402. Alternatively, the axle tube 414 can be put in place following securing the rear plate 416 to the base 402 or the back plate 406.

Following assembly of the chassis 102, axles can be applied to the axel block in the axle tube 414. Alternatively, the axels can be applied before assembly of the chassis 102. The wheels can be secured to the axles. In an example, the axles are quick release axles. Casters can be secured to the base plate 402 or caster plates 420 or 418.

Figure 11:
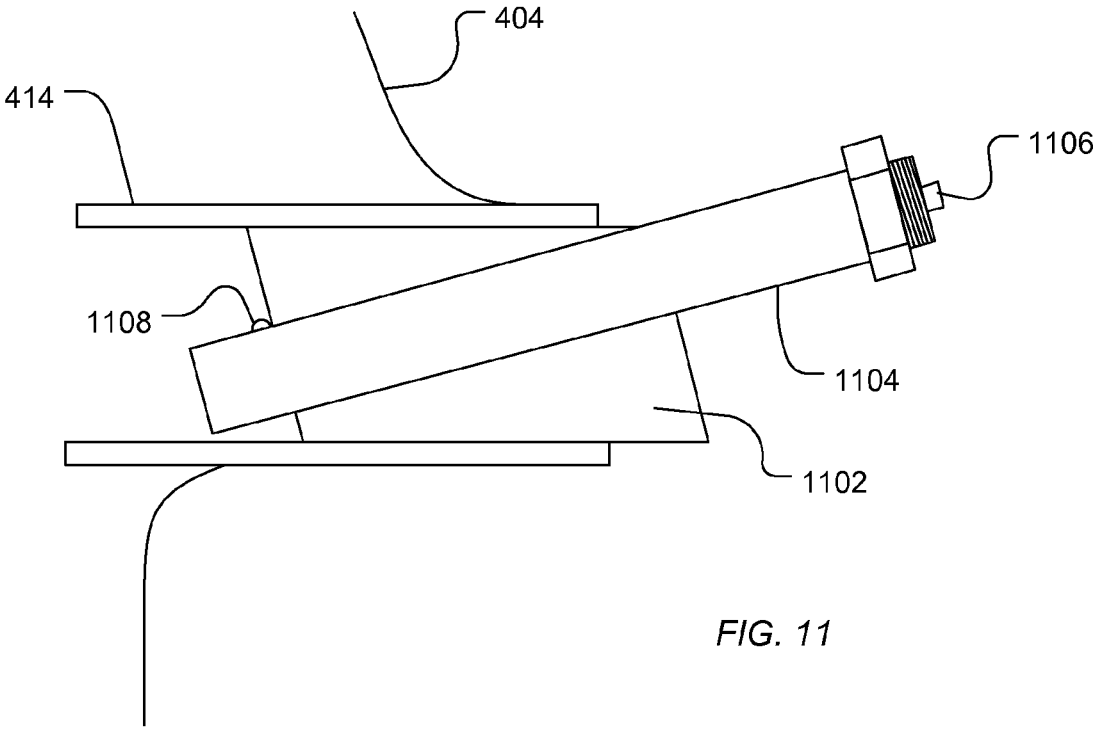
FIG. 11 includes an illustration of an exemplary axle tube and axle block.

As illustrated in FIG. 11, an axle block 1102 can be inserted into the axle support, such as axle tube 414. A quick release axle 1104 can be inserted into an axle hole of the axle block 1102. An angle of the axle hole defines the camber of the wheels. In a particular example, a quick release button 1106 on the axle 1104 causes a bearing 1108 to release, permitting removal of the axle 1104 from the axle block 1102. Alternatively, the axle block 1102 can be welded into the axle tube 414 and the axle block 1102 and axle tube 414 can be formed to be a single part. In another example, the axle block 1102 can be a bolt-in part to permit change out of the axle blocks to convert the chair to an everyday chair with vertical or close to vertical camber so the chair can fit through doorways. In an example, the axle tube 414 is bolted to the back plate 404 with the bolts passing through the axle tube 402, the axle block, and the back plate 404. Such construction permits different width axle tubes with which the user can select more clearance between the wheels and the seatback.

Figure 12:
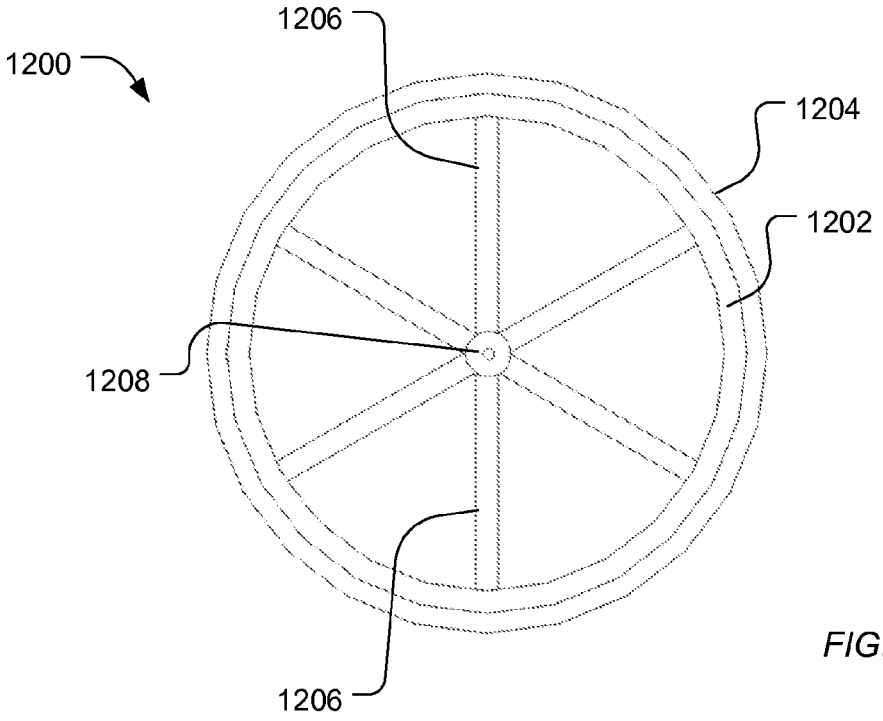
FIG. 12 includes an illustration of an exemplary wheel.

The wheels can be spoke wheels. Alternatively, the wheels can be cast wheels. For example, FIG. 12 illustrates a wheel 1200 that includes a rim 1202 and tire 1204. The rim 1202 includes a center hub 1208 and cast supports 1206 extending from the central hub 1208 to the rim 1202. The tire 1204 can be pneumatic. Alternatively, the tire 1204 can be a non-pneumatic tire. Optionally, various configurations from metal wire spokes to cast construction wheels with 3, 5, or 6 spokes can be used.

Chairs custom fit for individuals generally use tubular construction. However, there is demand for an institutional-type chair. Such an institutional chair is not custom fitted to the user, but rather available in a range of standard sizes. Chair maintenance is also a problem. A chair that is low maintenance or close to maintenance-free is desirable because the skill to maintain a fleet of conventional wheelchairs is not usually available. As such, a chair that does not utilize specialized skills for maintenance, such as those skills to lace, true, and maintain spoke construction main wheels would be desirable.

Able-bodied players can do things that their disabled counterparts cannot, such as standing on the footrest. A chair would desirably be designed to handle such alternate users' actions.

In particular, some of the durability issues, in the mixed able-bodied/disabled players' situations are related to able-bodied players being harder on the equipment than their disabled counterparts. Adjustable footrests are vulnerable as opposed to using a fixed position footrest. Further, fixing the footrest as opposed to making it adjustable reduces maintenance.

The sports wheelchair described herein reduces the amount of maintenance and can be available in a few of sizes (i.e., small, medium, large). The chair disclosed herein can be made in a small range of sizes, uses non-pneumatic, low maintenance cast main wheels, and has few or no adjustable components such as footrests and backrests.

In a first aspect, a wheelchair includes a chassis having a front and a rear opposite the front; first and second wheels coupled to the opposites sides of the chassis; a front caster coupled to the chassis under the chassis and proximal to the front of the chassis, lowest points of the first and second wheels and the front caster defining a ground plane; and a rear caster disposed proximal to the rear of the chassis. The chassis includes a base plate disposed proximal the ground plane; a back plate coupled to the base plate and extending from the base plate away from the ground plane; first and second side plates coupled to the base plate and extending from the base plate away from the ground plane and coupled to the back plate and extending from a front side of the back plate toward a front of the chassis and along opposites sides of the chassis; a rear plate coupled to the base plate and extending from the base plate away from the ground plane, the rear plate coupled to the back plate and extending from a rear of the base plate toward a rear of the chassis; and a seat coupled to the back plate and the first and second side plates opposite the base plate.

In an example of the first aspect, the wheelchair further includes a back support secured to the seat proximal to the rear of the chassis.

In another example of the first aspect and the above examples, the seat is tilted rearward at an angle in a range of 5 degrees to 15 degrees relative to a plane parallel to the ground plane.

In an additional example of the first aspect and the above examples, the wheelchair further includes a bumper secured to the base plate proximal to a front of the chassis.

In a further example of the first aspect and the above examples, the wheels are cambered at an angle in a range of 5 degrees to 20 degrees relative to a normal vector to the ground plane.

In another example of the first aspect and the above examples, the wheelchair further includes straps secured to the chassis to secure a user.

In an additional example of the first aspect and the above examples, the wheelchair further includes a second front caster.

In a further example of the first aspect and the above examples, the wheelchair further includes an axle support secured to the back plate; and axles to secure the wheels to the chassis.

In another example of the first aspect and the above examples, the axles are quick release axles.

In an additional example of the first aspect and the above examples, the rear caster extends no further rearward than a vertical plane that extends between the most rearward point of the two wheels and that is vertical to the ground plane.

In a further example of the first aspect and the above examples, the base plate includes at least one slot proximal to each of the first and second sides, and wherein the first and second side plates each include at least one tab to engage the at least one slot proximal to the respective first or second side.

In another example of the first aspect and the above examples, the base plate includes at least one back slot, and wherein the back plate includes at least one tab to engage the at least one back slot.

In an additional example of the first aspect and the above examples, the base plate includes at least one rear slot, and where the rear plate includes at least one tab to engage the at least one rear slot.

In a further example of the first aspect and the above examples, the back plate includes at least one side slot disposed proximal to each of the first and second sides, and wherein the first and second side plates include at least one back tab to engage the at least one side slot proximal to the respective first or second side.

In another example of the first aspect and the above examples, the back plate and the first and second side plates are welded to the base plate.

In an additional example of the first aspect and the above examples, the back plate and the first and second side plates are secured to the base plate using a mortise and tenon construction.

In a second aspect, a method of making a wheelchair includes applying a back plate and first and second side plates to a base plate, the base plate including at least one first side slots, at least one second side slots, and at least one back slots, the back plate including at least one back tabs to engage the at least one back slots of the base plate, the first side plate including at least one first side tabs to engage the at least one first side slots, and the second side plate including at least one second side tabs to engage the at least one second side slots. The method further includes attaching a seat to the back plate and the first and second side plates; attaching an axle support to the back plate; and attaching axles to the axle support to attach first and second wheels to the axles.

In an example of the second aspect, the method further includes coupling a front caster to the base plate.

In another example of the second aspect and the above examples, the method further includes coupling a rear caster to the base plate.

In a further example of the second aspect and the above examples, the method further includes coupling a back support to the seat.

Directions described herein are expressed in terms of the experience of a user. For example, a user sitting in a seat of the wheelchair faces towards the front and has a back towards the rear of the wheelchair. The user also has left and right sides corresponding to left and right sides of the wheelchair. When at rest, the user experiences up and down in relation to gravity, and the wheelchair correspondingly has a top and bottom.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A wheelchair comprising:

a chassis having a front and a rear opposite the front;

first and second wheels coupled to the opposites sides of the chassis;

a front caster coupled to the chassis under the chassis and proximal to the front of the chassis, the lowest points of the first and second wheels and the front caster defining a ground plane; and a rear caster disposed proximal to the rear of the chassis;

wherein the chassis comprises:

a base plate disposed proximal the ground plane;

a back plate coupled to the base plate and extending from the base plate away from the ground plane;

first and second side plates coupled to the base plate and extending from the base plate away from the ground plane and coupled to the back plate and extending from a front side of the back plate toward a front of the chassis and along opposites sides of the chassis;

a rear plate coupled to the base plate and extending from the base plate away from the ground plane, the rear plate coupled to the back plate and extending from a rear of the base plate toward a rear of the chassis;

a seat coupled to the back plate and the first and second side plates at a top of the back plate and the first and second side plates opposite the base plate; and an axle support secured to the back plate vertically between the base plate and the seat, the rear plate shaped to accommodate the axle support, the first and second wheels coupled to axles coupled to the axle support.

2. The wheelchair of claim 1, further comprising a back support secured to the seat proximal to the rear of the chassis.

3. The wheelchair of claim 1, wherein the seat is tilted rearward at an angle in a range of 5 degrees to 15 degrees relative to a plane parallel to the ground plane.

4. The wheelchair of claim 1, further comprising a bumper secured to the base plate proximal to a front of the chassis.

5. The wheelchair of claim 1, wherein the wheels are cambered at an angle in a range of 5 degrees to 20 degrees relative to a normal vector to the ground plane.

6. The wheelchair of claim 1, further comprising straps secured to the chassis to secure a user.

7. The wheelchair of claim 1, further comprising a second front caster.

8. The wheelchair of claim 1, wherein the axles are quick release axles.

9. The wheelchair of claim 1, wherein the rear caster extends no further rearward than a vertical plane that extends between the most rearward point of the two wheels and that is perpendicular to the ground plane.

10. The wheelchair of claim 1, wherein the base plate includes at least one slot proximal to each of the opposite sides of the chassis, and wherein the first and second side plates each include at least one tab to engage the at least one slot proximal to the respective opposite side.

11. The wheelchair of claim 1, wherein the base plate includes at least one back slot, and wherein the back plate includes at least one tab to engage the at least one back slot.

12. The wheelchair of claim 1, wherein the base plate includes at least one rear slot, and where the rear plate includes at least one tab to engage the at least one rear slot.

13. The wheelchair of claim 1, wherein the back plate includes at least one side slot disposed proximal to each of the opposite sides of the chassis, and wherein the first and second side plates include at least one back tab to engage the at least one side slot proximal to the respective opposite side.

14. The wheelchair of claim 1, wherein the back plate and the first and second side plates are welded to the base plate.

15. The wheelchair of claim 1, wherein the back plate and the first and second side plates are secured to the base plate using a mortise and tenon construction.

16. The wheelchair of claim 1, wherein the axle support has a rectangular prism configuration.

17. A method of making a wheelchair, the method comprising:

applying a back plate and first and second side plates to a base plate, the base plate including at least one first side slot, at least one second side slot, and at least one back slot, the back plate including at least one back tab to engage the at least one back slot of the base plate, the first side plate including at least one first side tab to engage the at least one first side slot, and the second side plate including at least one second side tab to engage the at least one second side slot;

attaching a rear plate to the base plate and the back plate;

attaching a seat to the back plate and the first and second side plates at a top of the back plate and at the top of the first and second side plates opposite the base plate;

attaching an axle support to the back plate vertically between the base plate and the seat, the rear plate shaped to accommodate the axle support; and attaching axles to the axle support to attach first and second wheels to the axles.

18. The method of claim 17, further comprising coupling a front caster to the base plate.

19. The method of claim 17, further comprising coupling a rear caster to the base plate.

20. The method of claim 17, further comprising coupling a back support to the seat.

* * * * *